US008002904B2

(12) United States Patent
Ragozzino

(10) Patent No.: US 8,002,904 B2
(45) Date of Patent: Aug. 23, 2011

(54) PLASTIC DUCT SYSTEM AND METHOD OF FABRICATION

(76) Inventor: Ronald Ragozzino, Norford, CT (US)

( * ) Notice: Subject to any disclaimer, the term of this patent is extended or adjusted under 35 U.S.C. 154(b) by 1023 days.

(21) Appl. No.: 11/890,764

(22) Filed: Aug. 7, 2007

(65) Prior Publication Data

US 2009/0038659 A1 Feb. 12, 2009

(51) Int. Cl.
*B08B 3/04* (2006.01)

(52) U.S. Cl. ..... 134/166 R; 134/169 R

(58) Field of Classification Search ..... 134/166 R, 134/169 R, 166 C, 169 C
See application file for complete search history.

(56) References Cited

U.S. PATENT DOCUMENTS

| | | | | |
|---|---|---|---|---|
| 212,773 | A * | 2/1879 | Webb et al. | 405/43 |
| 2,813,754 | A * | 11/1957 | Zielinski | 239/424 |
| 3,493,323 | A * | 2/1970 | Demuth | 422/28 |
| 4,241,020 | A * | 12/1980 | Grantham | 422/109 |
| 4,343,765 | A * | 8/1982 | Elston et al. | 422/3 |
| 5,003,998 | A * | 4/1991 | Collett | 134/22.12 |
| 5,664,423 | A * | 9/1997 | Akazawa | 62/78 |
| 5,756,047 | A * | 5/1998 | West et al. | 422/37 |
| 5,860,412 | A * | 1/1999 | Way | 126/299 E |
| 6,230,359 | B1 * | 5/2001 | Akazawa | 15/302 |
| 6,293,121 | B1 * | 9/2001 | Labrador | 62/304 |
| 6,457,481 | B1 * | 10/2002 | Tarala | 134/57 R |
| 6,758,502 | B2 | 7/2004 | Mattsson et al. | 285/424 |
| 6,874,700 | B2 * | 4/2005 | Ham et al. | 239/127 |
| 7,040,586 | B2 | 5/2006 | Kusber et al. | 248/200.1 |
| 7,128,558 | B2 | 10/2006 | Lum et al. | 425/326.1 |
| 7,153,124 | B2 | 12/2006 | Bergsma et al. | 425/384 |
| 7,191,489 | B1 | 3/2007 | Heath | 15/320 |
| 7,204,670 | B1 | 4/2007 | Meher-Homji et al. | 415/1 |
| 7,210,488 | B2 * | 5/2007 | Desormeaux | 134/22.18 |
| 7,361,304 | B2 * | 4/2008 | McVey et al. | 422/28 |
| 7,910,055 | B2 * | 3/2011 | Bondar | 422/31 |
| 2003/0056812 | A1 * | 3/2003 | Baker et al. | 134/36 |
| 2004/0265193 | A1 * | 12/2004 | Panice et al. | 422/186.04 |
| 2005/0178378 | A1 * | 8/2005 | Marshall et al. | 126/299 D |
| 2006/0121844 | A1 | 6/2006 | Sparks, II | 454/337 |
| 2006/0218931 | A1 * | 10/2006 | Haertel et al. | 60/775 |
| 2006/0279009 | A1 | 12/2006 | Hall et al. | 261/116 |
| 2007/0001030 | A1 | 1/2007 | Wang et al. | 239/533.1 |

FOREIGN PATENT DOCUMENTS

| | | | |
|---|---|---|---|
| FR | 2 721 964 | * | 1/1996 |
| JP | 04-197119 | * | 7/1992 |
| JP | 2005-205311 | * | 8/2005 |

OTHER PUBLICATIONS

European Patent Office 0 687 869 Dec. 1995.*

* cited by examiner

*Primary Examiner* — Frankie L Stinson
(74) *Attorney, Agent, or Firm* — Sofer & Haroun, LLP

(57) ABSTRACT

A duct system includes at least one duct for communicating air or fluid within a building that has a plurality of openings along the top of the duct along the central axis of the duct. An ingress pipe is coupled to the openings along the top of the duct. A plurality of openings are also provided along the bottom of the duct along the central axis of the duct, with a drain pipe coupled to the opening along the bottom of the duct. A user may inject a fluid into the duct ingress pipe and the fluid is drained and collected from the duct using the drain pipe.

13 Claims, 9 Drawing Sheets

PLASTIC DUCT SYSTEM AND METHOD OF FABRICATION

FIELD OF THE INVENTION

The present invention is in the field of ducts. More particularly, the present invention is in the field of ducts with improved cleaning capabilities.

BACKGROUND

Ducts provide transport passageways for a wide variety of applications. For example, ducts provide passageways for transporting gases for heating and ventilation in vehicles and buildings. Likewise, water distribution systems often use ducts for fluid transport. Ducts for the foregoing and other applications can be formed of metal, plastics, ceramics, composites, and other materials.

In HVAC (Heat Ventilation and Air Conditioning) systems, air passes through enclosed channels referred to as air ducts that communicate supply air from a central air handler via a centrifugal fan or blower to the various rooms of the building. Other ducts communicate return air from the rooms back to the central air handler for filtering, cooling, heating, and so forth. The supply air and even more so the return air ultimately contains dust, debris, and microbial contaminates. Gradually over time, some of these particulates accumulate on the interior walls of the air ducts. Excessive accumulation of these particulates degrades the performance of the air duct system by impeding necessary air flow. Similarly, significant portions of these contaminants can be redistributed to the air supply. Regular cleaning and maintenance activities eliminate a portion of the contaminants. Routinely changing the filters in an HVAC system will help remove air borne particles, but only to the degree that the filter is rated and only until the filter becomes loaded with debris.

The return duct is the dirtiest and most germ filled duct in air duct systems. All dirt gets stuck in the bottom, sides, and top of the duct. When some of the particles finally reach the filter, then they get trapped in the filter. The benefit of cleaning out the duct system is that by washing and decontaminating the ducts, germs, dustmites and other harmful bacteria are flushed out. In addition, when there is a good filter the heat and air conditioning system can perform better, reducing energy costs. There are some filters claiming that they can clean the air up to 99.9%, provided that the user maintains it, however, such claims belie the fact that the ducts remain full of contaminants without regular thorough cleanings.

OBJECT AND SUMMARY

A main objective of this system is to disinfect the germs and bacteria that develop in duct systems, or in systems that just cannot be maintained properly.

The present system provides a novel duct system with integrated nozzles for ingress and egress of washing fluids that reduces and/or eliminates the need for the time consuming process of manually cleaning the ducts.

To this end, the present invention provides for a duct system having at least one duct for communicating air or fluid within a building and a plurality of openings along the top of the duct along the central axis. An ingress pipe is coupled to the openings along the top of the duct along the central axis. A plurality of openings are also provided along the bottom of the duct along the central axis of the duct A drain pipe is coupled to the opening along the bottom of the duct along the central axis, where a user may inject a fluid into the duct using the ingress pipe and where the fluid is drained and collected from the duct using the drain pipe.

DETAILED DESCRIPTION

Figure 1:
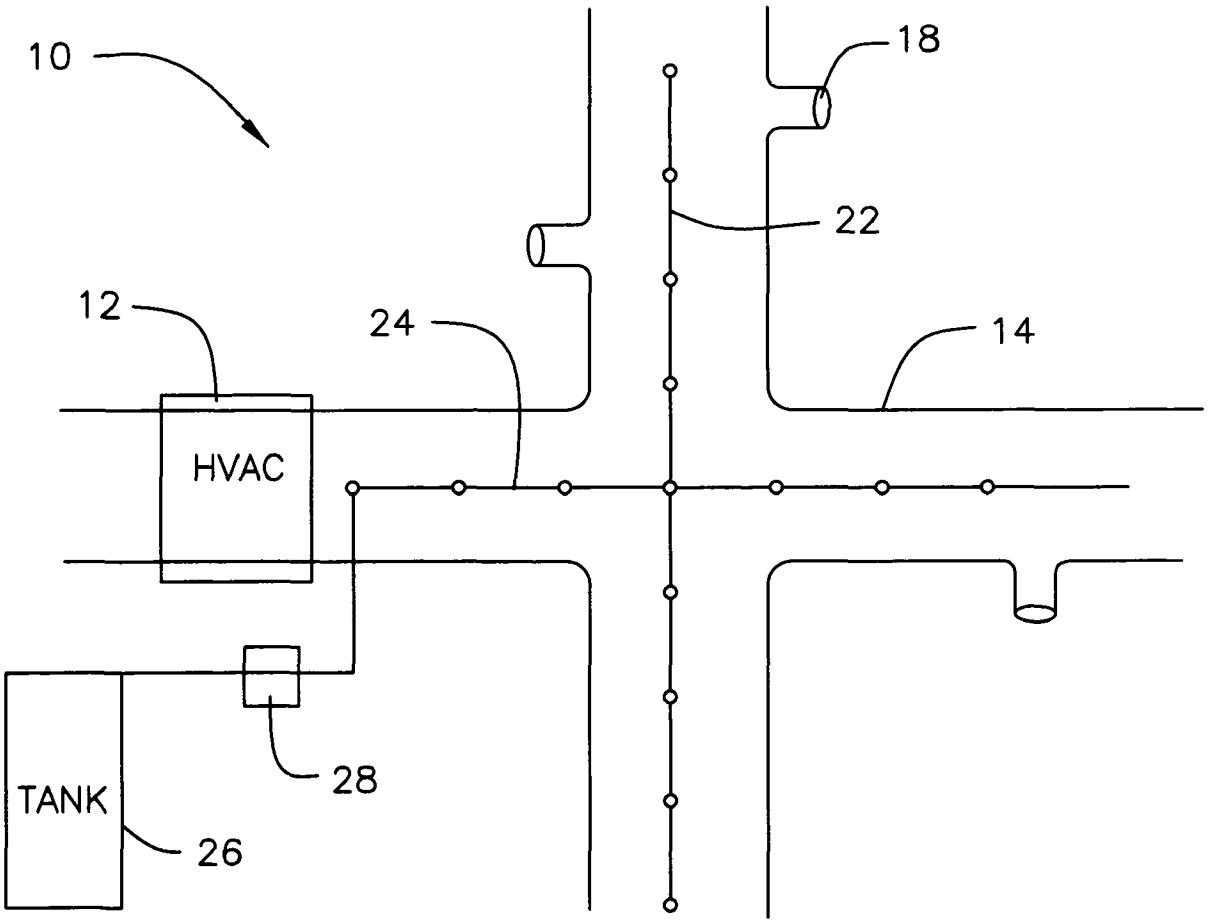
FIG. 1 is an underside view of a duct system in accordance with one embodiment.

In one embodiment, a duct system 10 is shown in FIG. 1 according to the present invention. This duct system employs features for allowing self-cleaning and draining of the cleaning fluid without the need for mechanical scrubbing. For the purposes of illustrating the salient features of the present invention, a simple cross-duct intersection is shown. However, it is understood that modifications and expansions may be employed along an entire duct system, such as those typically employed in a commercial or residential structure.

FIG. 1 illustrates an HVAC return duct system 10 from the underside showing an HVAC Unit 12 attached to a round central duct 14. A round side duct 16 intersects with round central duct 14. Air intake ports 18 extend from round side duct 16 and central duct 14 at various locations.

Duct system 10 and its component parts are preferably dimensioned according to industry standards and to accommodate the required air flow (CFM) for the systems they support. For example, a typical HVAC unit may require duct system 10 to handle 1200CFM such that central and side ducts 14 and 16 are dimensioned to between 10" and 20" in diameter. It is noted that the system, although shown with round ducts may be equally employed with square or rectangular ducts as well.

Figure 2:
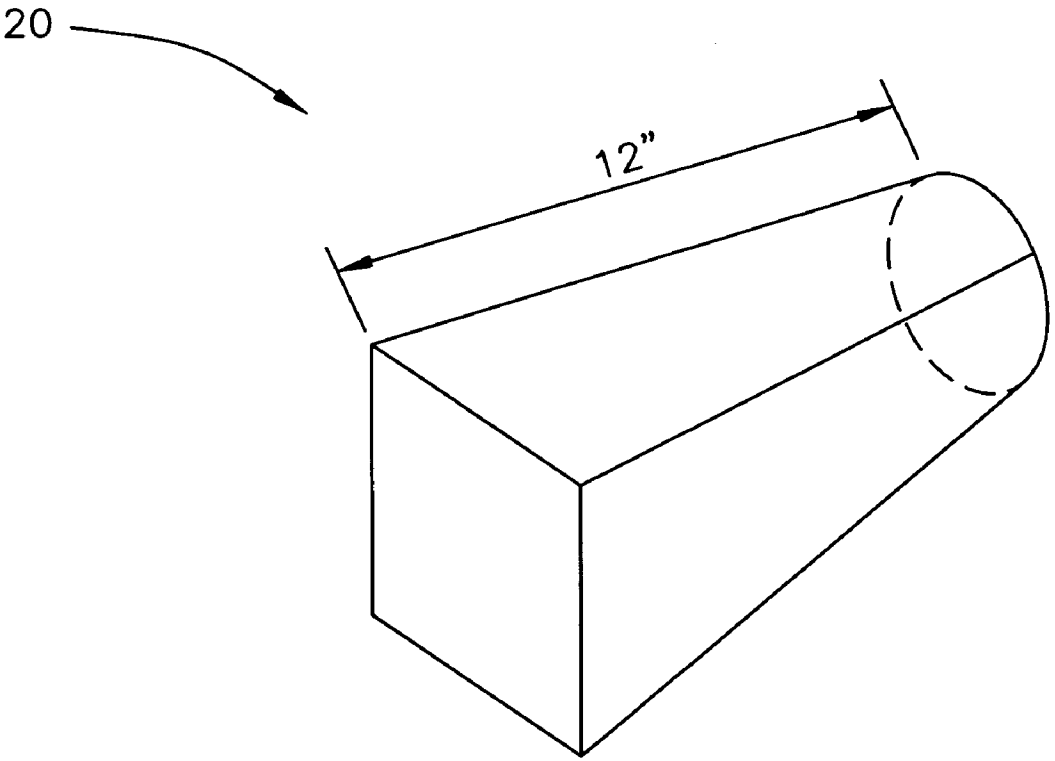
FIG. 2 is an illustration of an intake coupler according to one embodiment.

FIG. 2 shows an additional intake coupler 20 which connects a round intake port 18 to the typically square vents in the wall of the building. The top of intake coupler 20 is flat and the sides are pitched, so that water will drain back into the duct for removal if any collects outside of ducts 14 and 16. The length of intake coupler 20 is preferably 12 inches but other dimensions may be employed. The connection between intake coupler 20 and round intake port 18 may be flanged, gasketed, and screwed together so as to prevent unwanted water leakage.

Returning to FIG. 1, a series of drain openings 22 are illustrated, located along central axis of ducts 14 and 16. Drain openings 22 are connected by a drain pipe 24 that is attached to/built into ducts 14 and 16. Drain pipe 24 leads to a central waste pipe 26 which is connected to check valve 28. Piping 24 and 26 may be made from any desirable piping material including but not limited to PVC, metal and rubber/ polymer; and braided (non-burst) flexible lines. It is understood that drain openings 22, pipe 24 and waste pipe 26 are all dimensioned according to the desired liquid flow and pressure that is used, as described in more detail below.

Figure 3:
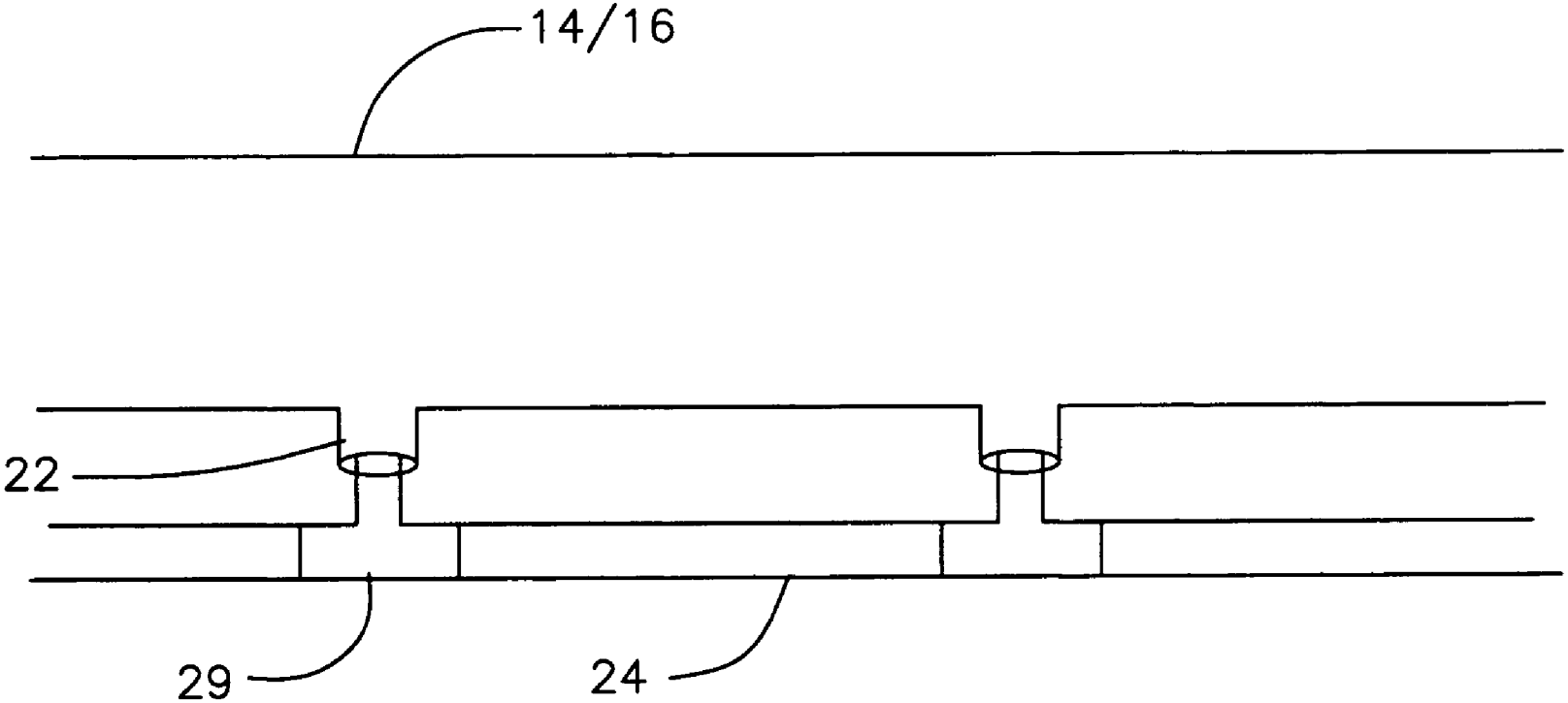
FIG. 3 is an underside view of a drain line on the duct of FIG. 1, in accordance with one embodiment of the present invention.

FIG. 3 depicts a close up of drain openings 22 with an attached drain coupling unit 29 which connects opening 22 with drain pipe 24.

Figure 4:
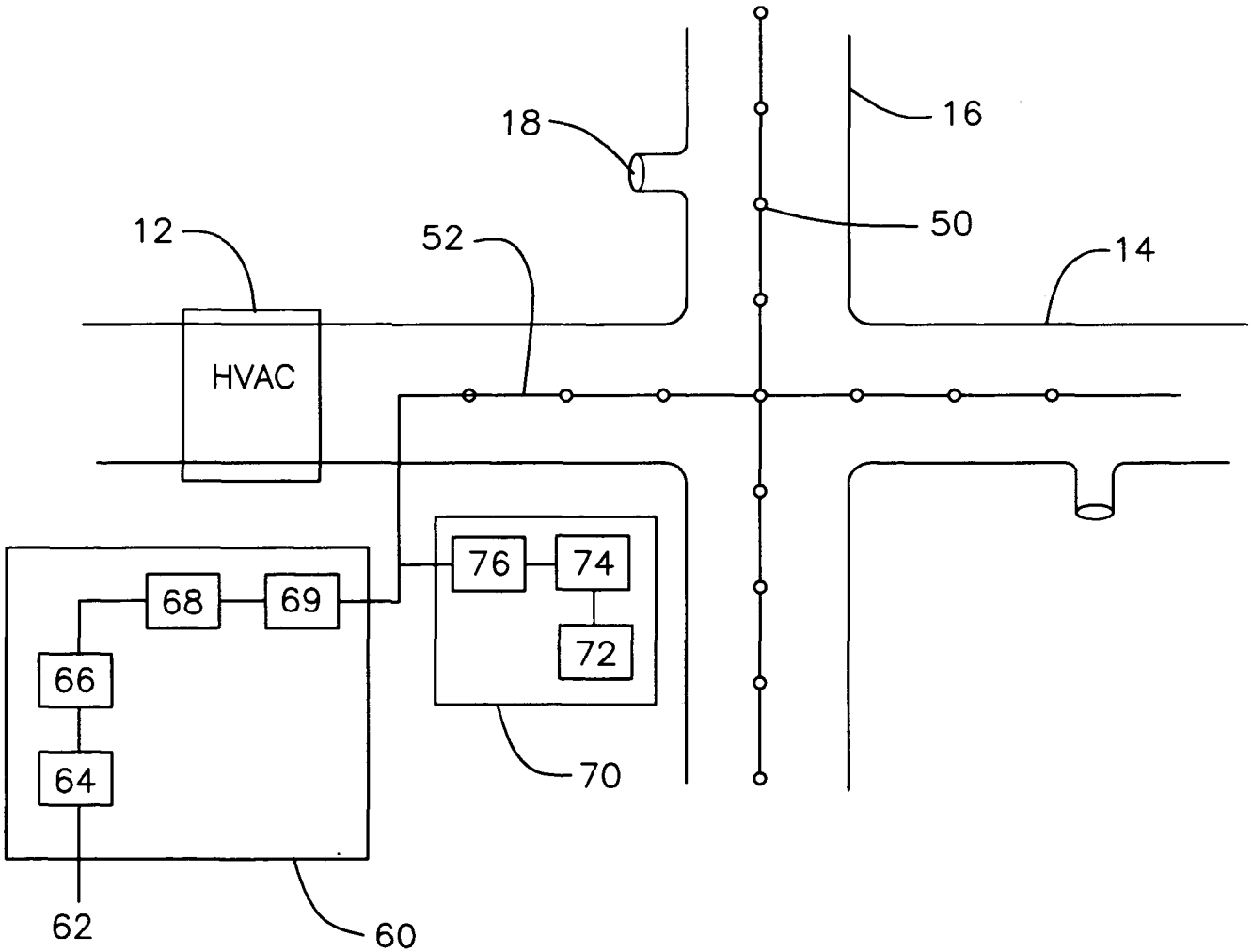
FIG. 4 is a top view of the duct system of FIG. 1 in accordance with one embodiment.

FIG. 4 is a top view of duct system 10 from FIG. 1. There are inlet openings 50 along the top central axis of ducts 14 and 16. Inlet openings 50 are connected by ingress piping 52. Ingress piping 52 is connected to both a water supply system 60 and a cleaner system 70.

Water supply system 60 is connected to a main water supply pipe 62, a back flow preventer (i.e. one way valve) 64, a filter 66, a solenoid 68 (main on/off switch) and check valve 69. Backflow preventer 64 prevents chemicals from entering the drinking water if such systems use the same main water supply pipe 62.

Cleaner system 70 has cleaner reservoir 72 which contains chemical disinfectants or other such cleaners, a pump 74 and solenoid 76. It is understood that the present invention, may operate with a water only arrangement (not shown) or with both water system 60 and cleaner system 70. It is noted that water supply system 60 and cleaner system 70 may each alone, or combined by coupled to an additional pumping system for extra pressurization during the below described cleaning process.

Figure 5:
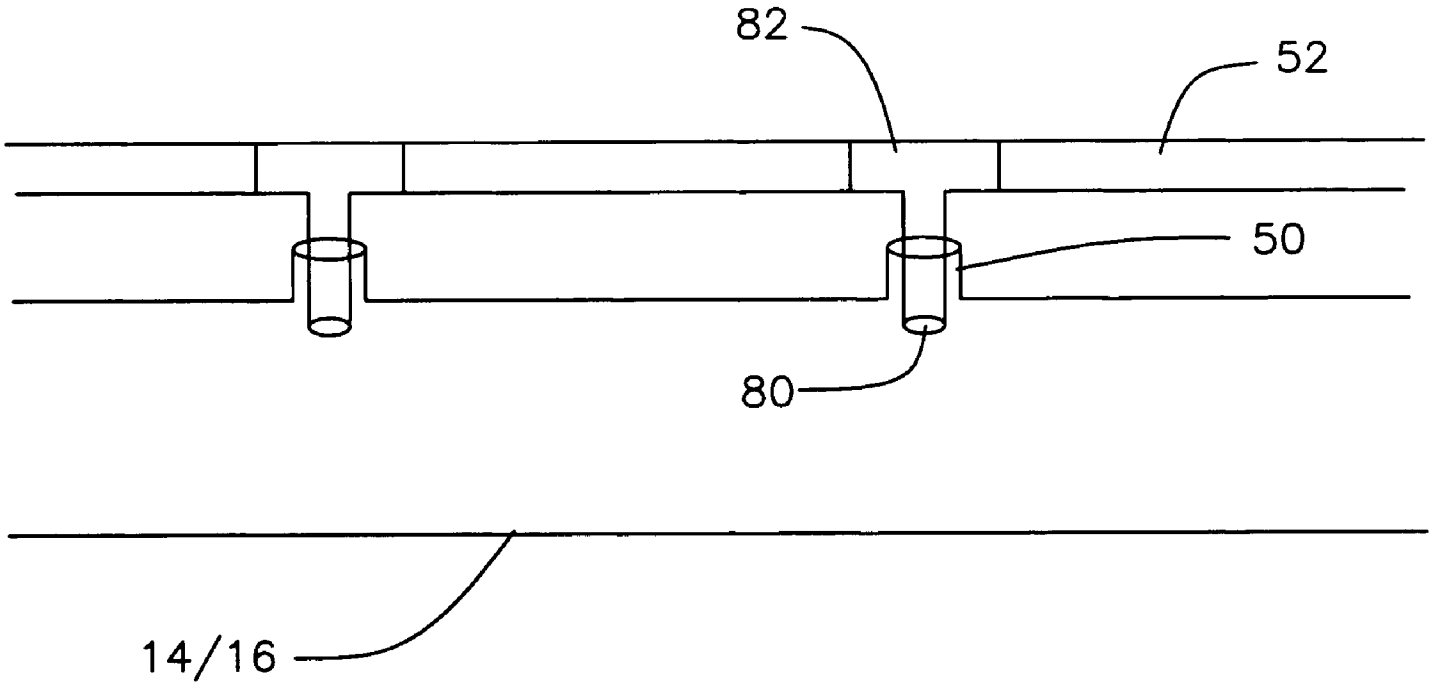
FIG. 5 is a top view of the duct of FIG. 1, in accordance with one embodiment.

FIG. 5 shows an up close top view of ducts 14 and 16. Nozzle 80 may be constructed as a multidirectional nozzle for an easy and effective spray around the entire nearby surface of the duct 14/16. A t-connector 82 connects ingress piping 52 to nozzle 80 through opening 50 in the duct 14/16.

In one embodiment, nozzle 80 may be constructed as any one of a rotating head, fixed pattern heads, spinning heads, multi functional heads, computer managed heads, moisture sensing heads, multi pattern heads, fixed heads, removable heads, different size (volume) heads, electrostatic heads which electrically remove dust particles. As with the piping in system 10, nozzle 80 is dimensioned according to the desired flow rate and pressures required by water supply system 60 and cleaner system 70.

Nozzles can also be installed in the HVAC 12 cooling coil to keep the coil clean automatically and keep the water that builds up on the drain pan clean and free of any bacteria or legionaries disease.

Figure 6A:
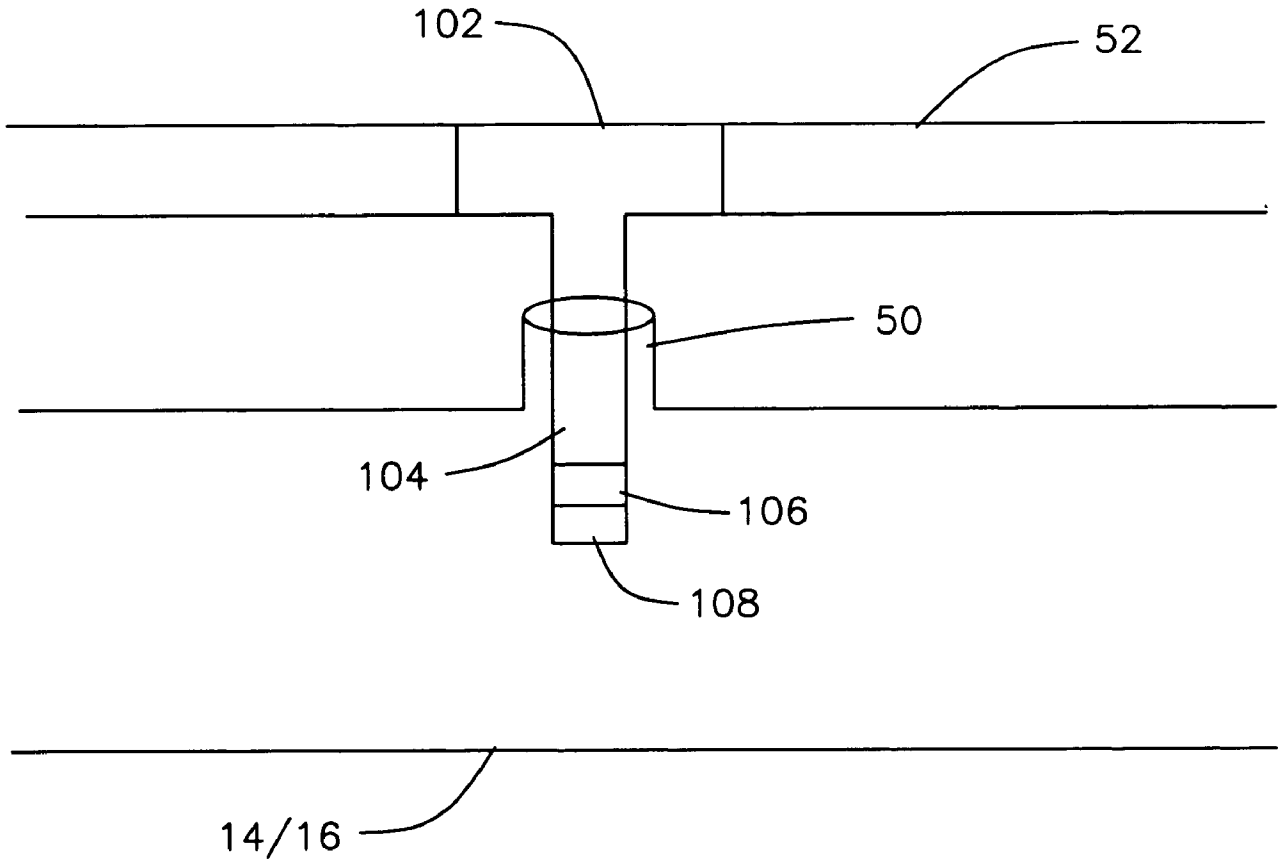
FIG. 6A is an illustration of a nozzle inserted into a duct of FIG. 1 in accordance with one embodiment.
Figure 6B:
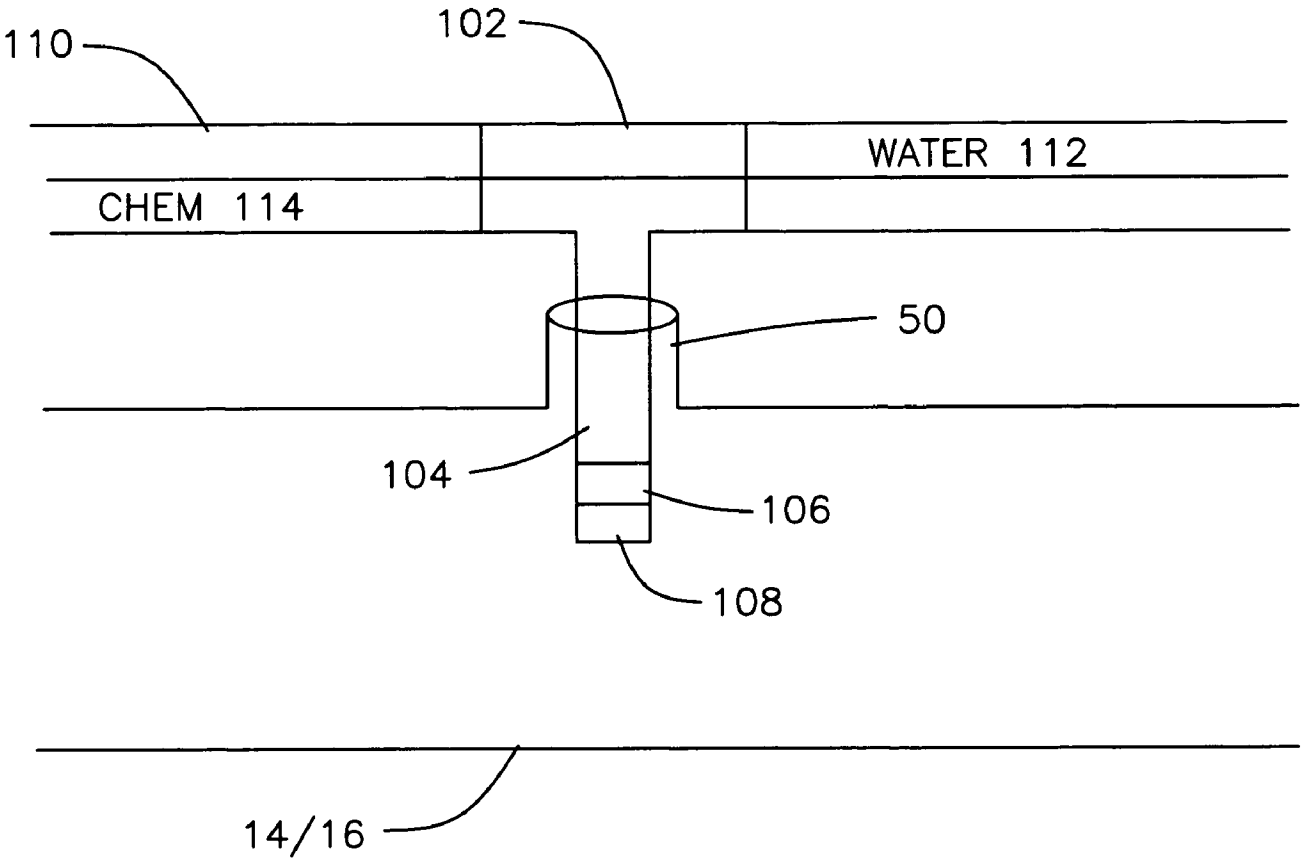
FIG. 6B is an illustration of a multiple tube ingress pipe with the duct of FIG. 1, in accordance with one embodiment.

In another embodiment of the present invention, FIG. 6A illustrates a multi purposes nozzle inserted into the duct system. T connect or 102 is attached through the upper opening 50 of duct 14/16. A dual mode nozzle 104 maintains two sprayers 106 and 108 with sprayer 106 being a chemical sprayer 106 and bottom sprayer 108 being a wash/water sprayer 108. FIG. 6B depicts an alternative ingress piping 110 having both a water channel 112 coupled to water sprayer 108 and a chemical channel 114 attached to chemical sprayer 106.

In another arrangement, above described nozzles, such as nozzles 80 may be included not only in duct system 10 but up to and including the HVAC unit 12, and in particular the cooling coils, such that the below described cleaning cycles may additional clean components of the HVAC that are in contact with airborne pollutants. Such nozzles 80 may further include a rotating head (powered externally or internally from fluid flow pressure) to ensure full coverage of the coils.

It is understood that the connections between the nozzles and ducts in system 10 may be either fixed or replaceable, allowing nozzle changes for different applications or maintenance on broken or dirty nozzles.

Regarding all above connection in duct system 10, it is contemplated that all connections between duct/nozzle/drain components are water tight, which may be arranged through any manner of water tight arrangements including but not limited to physical pressure sealed gaskets, permanent water proof cement/epoxy, water tight caulking/sealants etc. . . .

Figure 7:
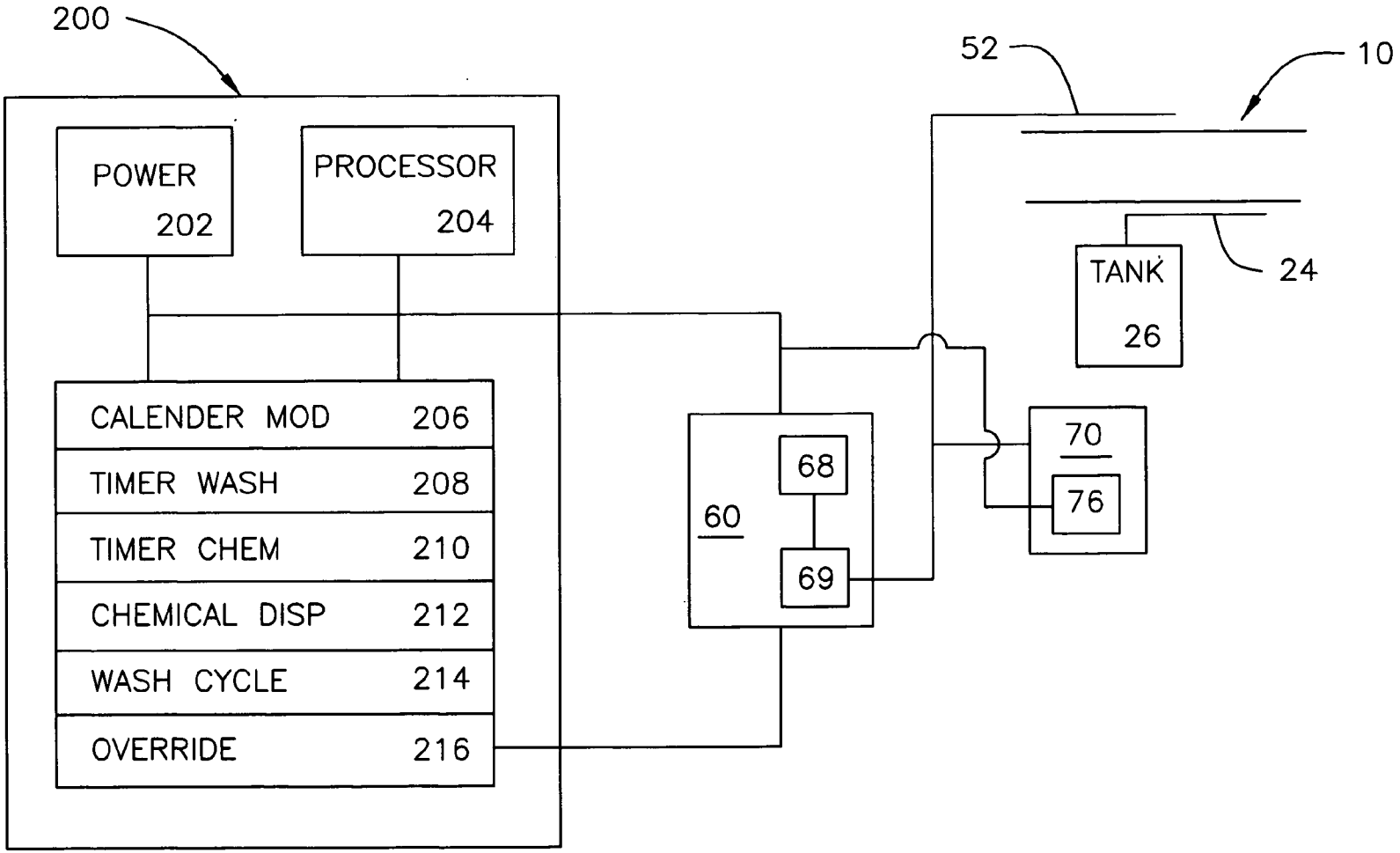
FIG. 7 is an illustration of a duct system control panel in accordance with one embodiment.

In one embodiment as portrayed in FIG. 7 that both embodiments would use a control panel 200 which is connected to main water supply 60 and cleaner system 70. The control panel contains of a power source 202 and a processor 204 for operating the pumps and solenoids. Processor 204 may employ calendar module 206, timer wash module 208, timer chemical module 210, chemical dispenser (volume) module 212, wash cycle module 214, and over ride switch 216. The various modules may be used for scheduling and executing cleaning cycles using the above described components. Override switch may be a manual switch or may alternatively/jointly be coupled directly to check valve 69. An optional touch screen display may be employed for a user interface.

In operation, upon a scheduled cleaning, water and/or chemicals are sprayed into the ducts via ingress piping 52 and nozzles 80 from water and cleaning systems 60 and 70. After the requisite amount of fluid is dispensed and an appropriate wait time elapses, the water is collected via exit openings 22 and drain piping 24 to the main waste collection tank 26. In one arrangement an added blower system may be used to energize the solenoids 68 and 76 so that the water from system 60 starts flowing and may be later used for drying once the wash cycles are complete.

In one arrangement, the first wash through of ducts 14 and 16 is with the chemicals from system 70. Then, system 10 may be washed again to clean all water lines (52) and nozzles 80 in order to prevent clogging.

In an exemplary wash cycle implemented by control panel 200 and duct system 10 a first water rinse may be scheduled for a 1 minute rinse. Next a 3 minute water/cleaner cycle may be employed for washing the system, followed by a 3 minute water only rinsing.

It is understood that durations of such washing/rinsing cycles may be adjusted along a wide range of times, and scheduled for daily, weekly, monthly etc. . . . cleanings. Such wash cycles are completely programmable through control system 200 with optional manual changes or overrides if necessary.

Figure 8:
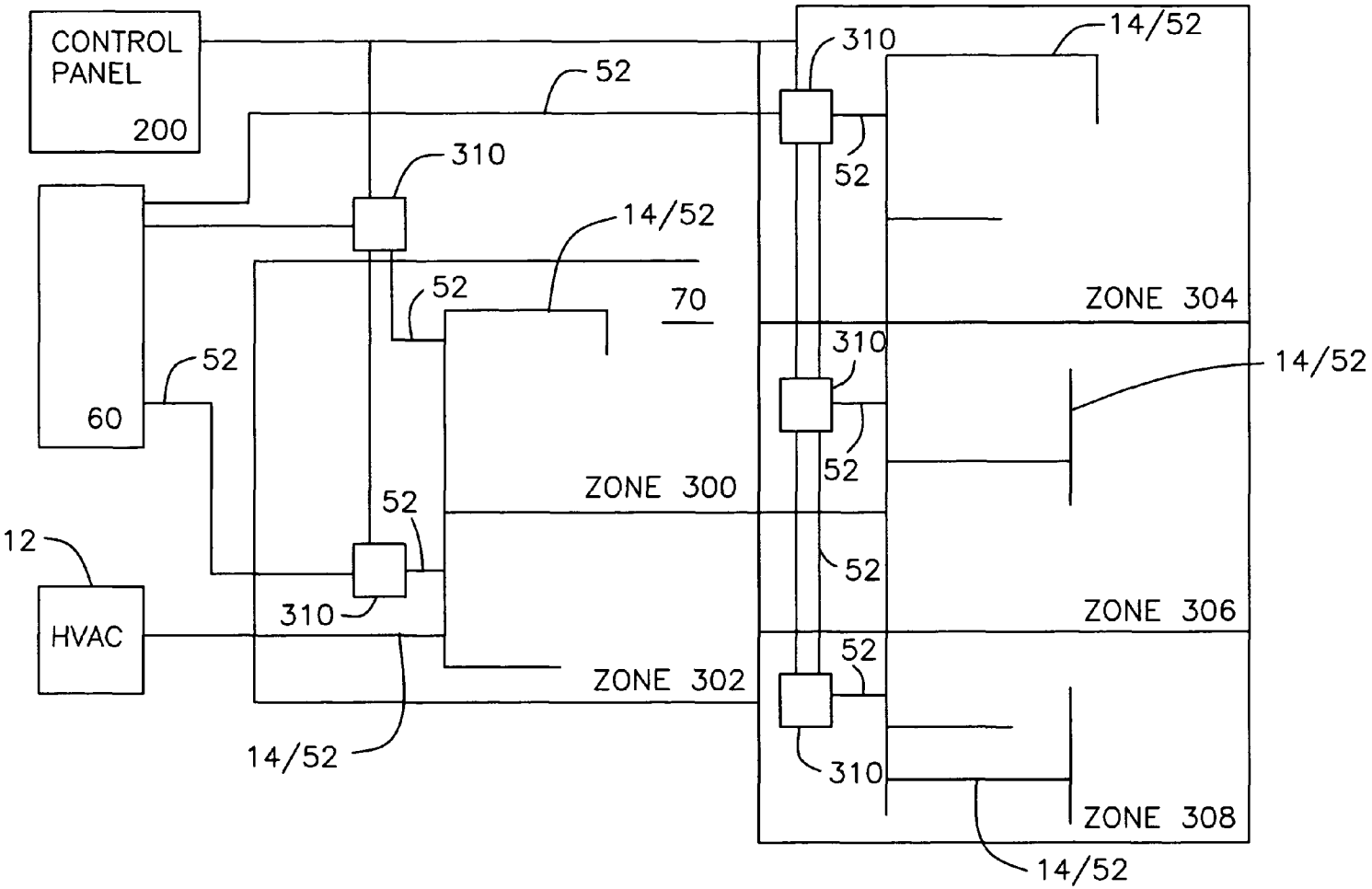
FIG. 8 illustrates a duct system with separate zones, in accordance with one embodiment.

In another embodiment, as illustrated in FIG. 8, duct system 10, when being employed in larger installations, may employ a zone system whereby portions of system 10 are subdivided into smaller zones to ensure complete coverage.

For example, as shown in FIG. 8 duct system 10 maintains five zones 300, 302, 304, 306 and 308. Within each zone, ducts 14 and 16 and their associated ingress piping 52 are coupled to water supply system 60 and cleaner system 70.

In a first option a single water supply system 60 may be employed with step-up pumps 310 for each zone 300-308 or alternatively, (not shown) individual water supply systems 60 can be employed for each zone. Control panel 200 as described above may be utilized in a similar manner controlling the cleaning/rinsing schedules for each zone.

Such an arrangement is advantageous when long sections of ducts 14 and 16 may result in poor coverage of cleaner and water in areas near the ends of ingress piping 52. The present arrangement remedies such a situation and prevents the need for very high pressure to reach the ends of system 10.

System 10 may be employed in all indoor and outdoor heating and HVAC systems, including rooftop HVAC applications. Other applications for plastic ductwork with adaptable nozzle parts could be used to purge air through nozzle systems for various reasons with fragrances of different scents.

In an alternative embodiment, system 10 may be retrofitted with any tight fitting duct system. For example, in an existing watertight duct system, a hole may be drilled into the upper section of the duct to allow for a water nozzle to be inserted. A drainage opening can be made in the duct oppose the water nozzle to allow for removal of the cleaning fluid.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A duct system comprising:

at least one horizontally mounted air duct for communicating air within a building said air duct having at least one air inlet and one air outlet;

a first plurality of openings along the top of said at least one horizontal mounted air duct along the central axis of said air duct, said first plurality of openings defining an axis along the top center line of said horizontally mounted air duct;

an ingress pipe coupled to said plurality of first openings along the top of said duct along said axis along the top center line of said air duct, said ingress pipe configured to carry cleaning fluid substantially along the length of said at least one air duct;

a second plurality of openings along the bottom of said air duct, said second plurality of openings defining an axis along the bottom center line of said horizontally mounted air duct opposite said plurality of first openings, each of said second openings being distributed along said air duct in a manner to collect substantially all of said cleaning fluid brought into said air duct by said ingress pipe through said first plurality of openings; and a drain pipe coupled to each of said second openings along the bottom of said air duct, wherein a user may inject a fluid into said air duct using said ingress pipe and wherein said fluid is drained and collected from said air duct via said plurality of second openings and through said drain pipe, wherein said at least one horizontally mounted air duct has at least one air intake port for allowing air to enter said duct, said air intake port being coupled to an flatly arranged intake coupler having pitched sides.

2. The duct system as claimed in claim 1, wherein, said first openings along the top of said duct along the central axis of said air duct are fitted with a multi directional nozzle for spraying said fluid into said air duct.

3. The duct system as claimed in claim 1, wherein said ingress pipe is connected to water supply such that said fluid introduced into said air duct is water.

4. The duct system as claimed in claim 3, wherein said ingress pipe is connected to a chemical supply such that said fluid introduced into said air duct is a chemical agent.

5. The duct system as claimed in claim 4, wherein said water supply maintains a backflow preventer for preventing chemical agents from entering the water supply.

6. The duct system as claimed in claim 4, further comprising a control panel, wherein said water supply and said chemical supply are controlled by automation.

7. The duct system as claimed in claim 6, wherein said control panel is configured to provide scheduled wash and rinse cycles using said water supply and said chemical supply.

8. The duct system as claimed in claim 4, wherein said air duct system is divided into a plurality of zones, controlled independently from one another.

9. The duct system as claimed in claim 8, wherein each of said zones, maintains an independent water supply and chemical supply section.

10. The duct system as claimed in claim 8, wherein each of said zones is supplied from a single water supply, and wherein each zone includes a step-up pump for providing sufficient pressure.

11. The duct system as claimed in claim 1, wherein said pitched sides of said air intake port are dimensioned and arranged so that fluids entering into said horizontally mounted air duct drain backwards into said duet for removal through said second plurality of openings along the bottom of said air duct.

12. The duct system as claimed in claim 1, wherein said ingress pipe is a bifurcated pipe having a water channel coupled to a to a water supply such that said fluid introduced into said air duct is water and a chemical channel coupled to a chemical supply such that said fluid introduced into said air duct is a chemical agent.

13. The duct system as claimed in claim 12, further comprising a multi-head nozzle, wherein said nozzle has a water sprayer connected to said water channel and a chemical sprayer connected to said chemical sprayer.

* * * * *